US005078615A

United States Patent [19]

Benson et al.

[11] Patent Number: 5,078,615

[45] Date of Patent: Jan. 7, 1992

[54] CONNECTOR FOR USE WITH MEDICAL INSTRUMENTS

[75] Inventors: James A. Benson, Bellevue; Jack D. Howard, Bothell, both of Wash.

[73] Assignee: Physio-Control Corporation, Redmond, Wash.

[21] Appl. No.: 349,188

[22] Filed: May 9, 1989

[51] Int. Cl.[5] ..... H01R 13/629

[52] U.S. Cl. ..... 439/246; 29/837; 128/419 D

[58] Field of Search ..... 439/190, 194, 389, 595, 439/31, 246–248, 341, 588, 592, 597, 600, 603, 627, 826, 909; 128/419 D; 29/837

[56] References Cited

U.S. PATENT DOCUMENTS

| | | | |
|---|---|---|---|
| 4,268,101 | 5/1981 | Stone | 439/909 |
| 4,590,943 | 5/1986 | Paull et al. | 128/419 D |
| 4,614,395 | 9/1986 | Peers-Trevarton | 437/389 X |
| 4,704,091 | 11/1987 | Owens et al. | 439/597 X |
| 4,865,566 | 9/1989 | Rasmussen et al. | 439/825 |
| 4,915,109 | 4/1990 | Daynes et al. | 128/419 D |
| 4,934,367 | 6/1990 | Daglow et al. | 439/527 |

FOREIGN PATENT DOCUMENTS

| | | | |
|---|---|---|---|
| 599907 | 7/1934 | Fed. Rep. of Germany | 439/600 |
| 1025478 | 3/1958 | Fed. Rep. of Germany | 439/825 |
| 1465719 | 1/1967 | France | 439/825 |

*Primary Examiner*—Eugene F. Desmond

*Attorney, Agent, or Firm*—Christensen, O'Connor, Johnson & Kindness

[57] ABSTRACT

A connector (10) is disclosed for providing a connection, for example, a battery pack (16) and a medical instrument (14). The connector includes a grommet (18), which flexibly secures an internal conductive post (24) and external conductive post (26) to the instrument. Drop-shaped external and internal sections 28 and 32 of grommet 18 cooperatively engage external and internal flanges 54 and 58 on the instrument to restrict rotation of the connector, while a central section 30 of the grommet has a circular cross section to provide a seal between the connector and the instrument in the event the connector does rotate. The external section of the grommet is compressed slightly by the battery pack upon insertion into the instrument. A connector constructed with these features can be easily removed from the instrument for servicing and seals the interior of the instrument as well as connections made to the external post.

16 Claims, 2 Drawing Sheets

CONNECTOR FOR USE WITH MEDICAL INSTRUMENTS

FIELD OF THE INVENTION

This invention relates generally to connectors and, more particularly, to connectors for use with medical instruments.

BACKGROUND OF THE INVENTION

Connectors have been developed for use in medical instruments in a variety of ways. For example, connectors may be used to connect a medical instrument to a source of power or information used by the instrument. Connectors may also join subsystems within the instrument and couple the instrument to external systems that respond to the instrument's output. The types of connections provided by the connectors are most commonly electrical and/or mechanical.

A variety of styles of connectors are used in medical instruments. The particular style selected is often a function of a number of factors. For example, in certain applications, the connector must allow connections to be made and broken quickly and easily, with minimal human involvement. In other applications, it is more important to ensure that a secure connection is produced, providing good electrical contact between the connected components and minimizing the possibility of mechanical separation.

In one particular application of interest, a pair of connectors are rigidly mounted in the battery tray of a medical instrument to engage hollow cylindrical terminals provided adjacent one end of a battery pack. Each connector includes a conductive post having a radially compressible "banana" end that projects out of the instrument, and a threaded end that projects into the instrument. The banana ends are designed to be received and radially compressed by the battery pack terminals, while the threaded ends are connectable to the internal wiring of the instrument by ring terminals and nuts.

The battery pack is connected to the instrument in the following manner. Although the path followed by the battery pack as it is inserted into the tray may vary somewhat, it generally includes two components. First, the battery pack is moved in a plane defining an acute angle with respect to the tray, as the end of the battery pack opposite the terminals is inserted into the battery tray. Second, the battery pack is rotated slightly, moving the battery pack terminals into engagement with the banana ends of the connectors.

In practice, the battery pack is inserted with a single sweeping motion that includes both of these components. While this motion allows the battery pack to be quickly and easily connected to the instrument, the rotational component prevents the posts and terminals from being aligned at all times. Thus, stresses may be applied to the connector during insertion.

To reduce these stresses, the banana posts and the battery pack terminals are aligned at a slightly nonperpendicular angle to the battery tray and battery pack, respectively. If the battery pack terminals are considered to sweep an arc during insertion of the battery pack into the tray, the posts and terminals are roughly tangentially aligned to that arc. As a result, the posts and terminals remain relatively closely aligned during the entire insertion process, reducing the lateral force and, hence, stress applied to the posts.

Another feature of this connector relates to the protection of the inner circuits and systems of the instrument. By rigidly molding the connector into the housing of the instrument, an excellent seal is provided around the post, limiting the intrusion of moisture or particulate into the instrument. This can be particularly important when the instrument is designed to allow batteries to be changed in the field, where a variety of environments may be experienced.

In addition, in some instances it may be desirable to check internal connections made to the connector, or replace the connector entirely. With conventional connectors this may either be impossible or require access to the inside of the instrument, which can be inconvenient and time consuming. Thus, it would be helpful to allow this type of field service to be accomplished without requiring partial disassembly of the instrument.

It would also be desirable to provide a connector that offers a good seal between the battery pack and the connector, as well as between the interior and exterior of the instrument. Further, it would be helpful to develop a connector that makes removal of the battery pack from the tray easier. Finally, to decrease manufacturing costs, it would be useful to provide a connector that can be positioned on the housing within relatively loosely defined tolerances and still assure proper alignment of the connectors.

SUMMARY OF THE INVENTION

In accordance with this invention, an apparatus is provided for making a connection to a medical instrument. The apparatus includes a connector for providing the connection to the medical instrument and a support for flexibly connecting the connector to the instrument. The connector includes a first conductive post secured to the support and a second conductive, banana, post securable to the first post.

In accordance with a particular aspect of this invention, a grommet is provided for insertion into the housing of a medical instrument to support a connector. The grommet is designed to restrict rotation with respect to the housing and sealably engages the housing regardless of its rotational position with respect to the housing. In a preferred arrangement, the grommet may include sections projecting from either side of the housing that are noncircular in cross section, while the portion of the grommet extending through the housing is circular in cross section.

BRIEF DESCRIPTION OF THE DRAWINGS

The invention will presently be described in greater detail, by way of example, with reference to the accompanying drawings, wherein.

DETAILED DESCRIPTION OF THE PREFERRED EMBODIMENT OF THE INVENTION

Figure 1:
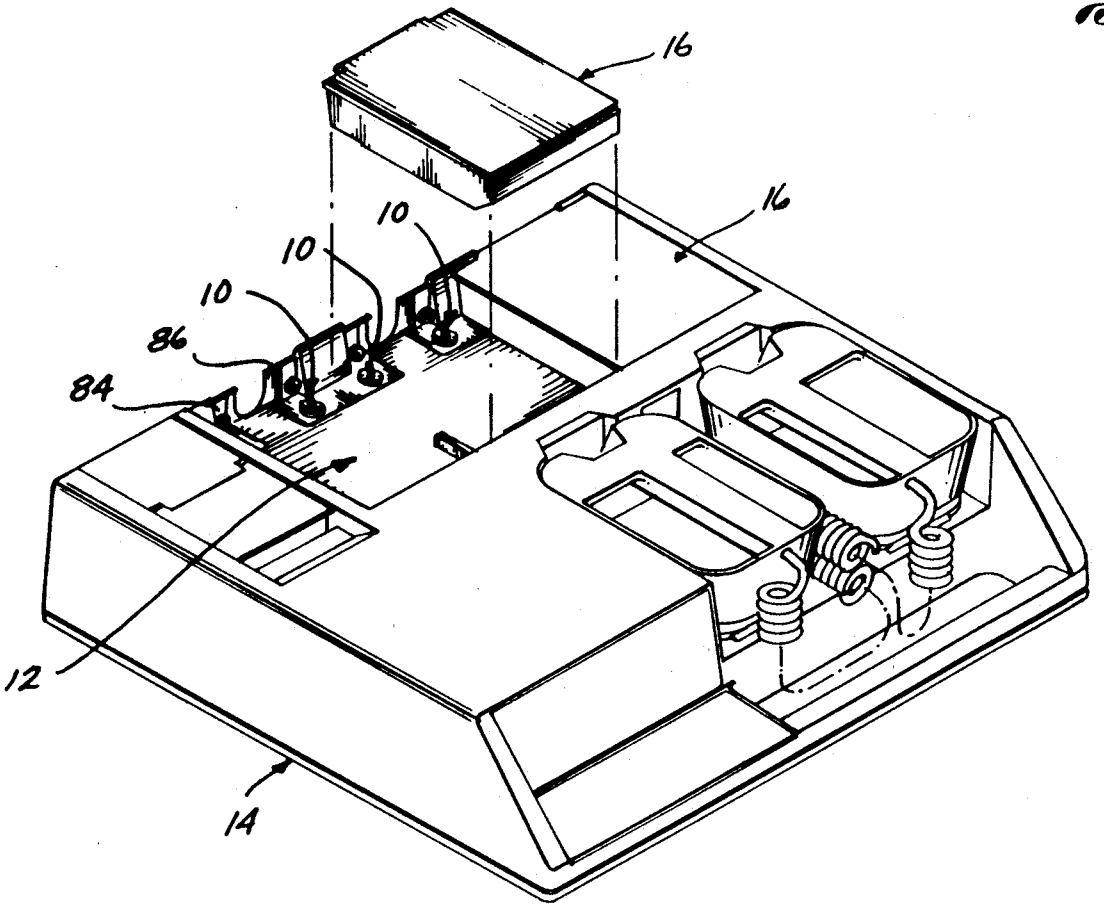
FIG. 1 is an isometric view of a defibrillator employing connection posts constructed in accordance with the present invention to electrically and mechanically connect the defibrillator to a plurality of battery packs.

Referring now to FIG. 1, a plurality of connectors 10 constructed in accordance with this invention are shown mounted in the battery tray 12 of a defibrillator 14. The connectors 10 mechanically and electrically couple defibrillator 14 to a plurality of battery packs 16.

As described in greater detail below, the connectors 10 are designed to minimize any stress applied to the connectors 10 during insertion of a battery pack 16 into tray 12. The construction of connectors 10 also allows defibrillator 14 to be more easily serviced in the field. Further, the connectors 10 provide a good seal between the interior of defibrillator 14 and tray 12, as well as between tray 12 and battery pack 16. The connectors 10 also enhance the removal of battery pack 16 from tray 12. Finally, the connectors 10 are designed to allow less stringent tolerances to be employed in the positioning of connectors 10 with respect to tray 12.

Figure 2:
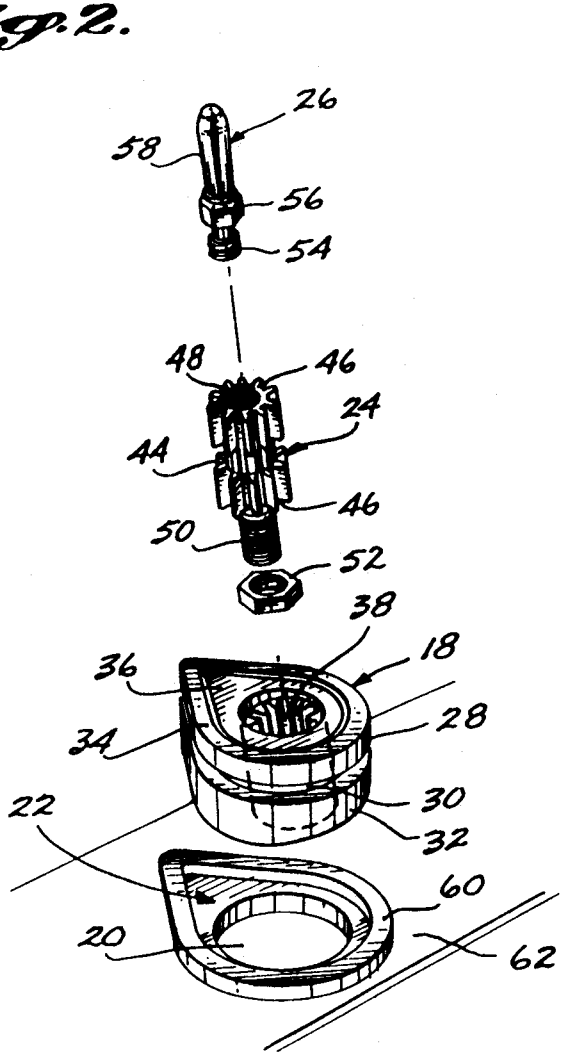
FIG. 2 is an exploded isometric view of one of the connection posts illustrated in FIG. 1 and the portion of the defibrillator to which the connection post is attached.

Addressing now the construction of connector 10, reference is had to FIG. 2. As shown, the preferred embodiment of connector 10 includes a grommet 18 that is inserted into an opening 20 provided in the bottom wall 22 of battery tray 12. Connector 10 also includes an internal post 24 that projects into the interior of defibrillator 14 and an external post 26 that projects into the battery tray 12.

Describing these components of connector 10 in greater detail, grommet 18 is molded as a single piece of neoprene. For convenience of description, however, grommet 18 will be considered to include an external section 28, a central section 30, and an internal section 32. When viewed from a reference plane parallel to the bottom wall 22 of battery tray 12, the external section 28 of grommet 18 has a drop-shaped perimeter with major and minor diameters that are both greater than the diameter of opening 20. The upper surface 34 of the external section 28 is provided with a drop-shaped depression 36 having a beveled perimeter that is slightly smaller in dimension than the perimeter of section 28.

The central section 30 of grommet 18 extends from the external section 28 and has a circular cross section when viewed in a reference plane parallel to the bottom wall 22 of tray 12. The diameter of central section 30 closely approximates the diameter of opening 20. Similarly, the thickness of central section 30, perpendicular to the reference plane, closely approximates the thickness of the wall 22 around opening 20.

The internal section 32 of grommet 18, like external section 28, is connected to the central section 30 and has a perimeter that is drop-shaped when viewed in a reference plane parallel to bottom wall 22. Unlike the external section 28 of grommet 18, the perimeter of internal section 32 becomes progressively smaller with distance from the central section 30. The thickness of internal section 32, perpendicular to the reference plane, also varies, being greatest near the corner of the drop. Further, the internal section 32 has rounded corners to allow grommet 18 to be more easily inserted into the opening 20 in the bottom wall 22 of battery tray 12.

Figure 3:
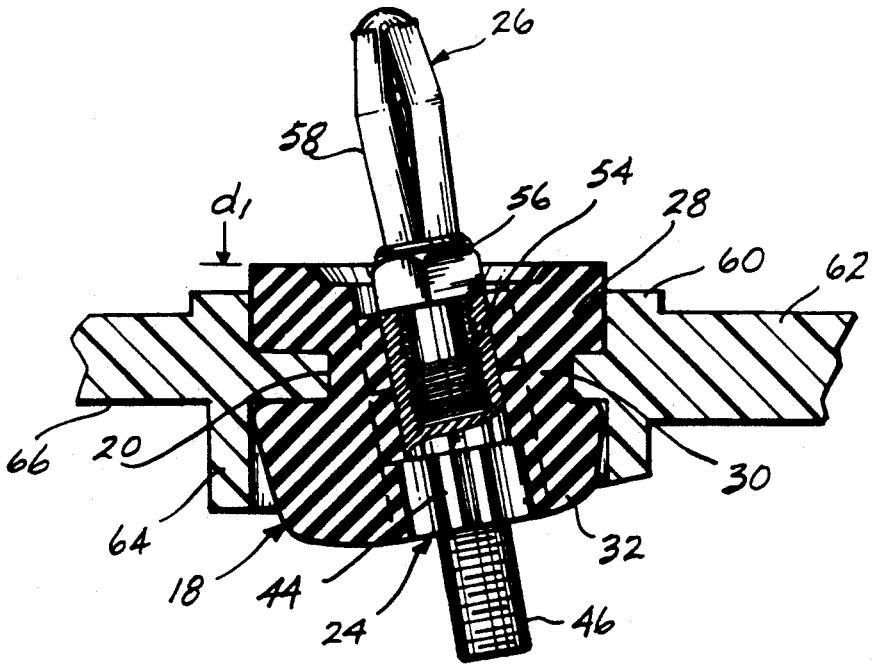
FIG. 3 is a sectional view of the connection post of FIG. 2 attached to the defibrillator.

The grommet 18 is injection molded about the internal post 24 of the connector 10, effectively defining a passage 38 in which the internal post 24 is received. The passage 38 extends through the external, central, and internal sections 28, 30, and 32 of grommet 18 along an axis that forms an angle of roughly 80 degrees with respect to the upper surface 34 of grommet 18. As described below, passage 38 is dimensioned to receive and cooperatively engage a portion of the internal post 24. Passage 38 includes an external opening 40 adjacent the drop-shaped depression 36 provided in the external section 28 of grommet 18, and an internal opening 42 adjacent the end of internal section 32 projecting into the interior of the defibrillator 14. As shown in FIG. 3, the length of passage 38 is slightly greater than the length of the embedded portion of internal post 24.

Addressing now the construction of the internal and external posts 24 and 26, the internal post 24 has a head 44 that is provided with two pairs of flutes 46 extending radially about the axis of post 24. As a result, the head 44 generally resembles a pair of spaced-apart gears. The head 44 of post 24 may be either molded into grommet 18 or manually inserted into the passage 38 extending through grommet 18. A threaded opening 48 is provided at one end of the head 44, while a threaded shaft 50 projects from the other end. One nut 52 is provided on the threaded shaft 50 of post 24 to allow a spade or ring terminal on the internal wiring of the defibrillator 14 to be electrically coupled to connector 10.

As shown in FIG. 2, the external post 26 includes a threaded section 54 that mates with the threaded opening 48 of the internal post 24. A hexagonal section 56 is provided adjacent the threaded section 66 to allow external post 26 to be rotatably secured in opening 48 with the aid of, for example, a wrench. A conventional banana post 58 projects from the hexagonal section 56 and includes four radially protruding spring sections for engaging the walls of a cylindrical mating connector described below in connection with battery pack 16.

Addressing now the opening 20 provided in the bottom wall 22 of battery tray 12, reference is had to FIGS. 2 and 3. As shown, opening 20 has a thickness that is slightly less than the thickness of the bottom wall 22. An external flange 60 is provided on the external surface 62 of bottom wall 22 around opening 20, while an internal flange 64 is provided on the internal surface 66 around opening 20. The external flange 60 and internal flange 64 define external and internal openings 68 and 70, respectively, adjacent opening 20. Openings 68 and 70 have cross-sectional areas that are slightly greater than those of the external and internal sections 28 and 32 of grommet 18. The thickness of external flange 60 and the thickness of the external section 28 of grommet 18 are selected to allow the upper surface 34 of grommet 18 to project a distance, d, above flange 60 when connector 10 is inserted into opening 20.

Referring now to the partial sectional view of FIG. 3, an assembled connector 10 is shown secured in opening 20. As will be appreciated, the tapered and rounded nature of the internal section 32 of the grommet 18 allows the connector 10 to be manually inserted into, and removed from, opening 20 from the exterior of the defibrillator 14. In addition, the threaded relationship between posts 24 and 26 allows the external post 26 of connector 10 to be checked or replaced in the field, without opening the defibrillator 14. These features can significantly decrease repair time and minimize the likelihood that the interior of the defibrillator 14 will be damaged.

With the connector 10 inserted as shown in FIG. 3, the cooperative engagement between the drop-shaped external and internal sections 28 and 32 of grommet 18 and the external and internal flanges 54 and 58 on the bottom wall 22 of tray 12 limits rotation of the connector 10. This feature is included to protect the internal wiring of defibrillator 14 connected to the internal post 24. More particularly, if connector 10 were free to rotate in opening 20, the internal wiring of defibrillator 14 could twist or wrap around the internal post 24 and break.

As will be appreciated, various other noncircular cross sections could be employed for the external and internal sections 28 and 32 of grommet 18 and the external and internal flanges 60 and 64 around opening 20. For example, the sections 28 and 32 and flanges 60 and 64 could have triangular, rectangular, or oval cross sections. In each case, rotation of the connector 10 out of alignment with flanges 60 and 64 would cause an interference between grommet 18 and flanges 60 and 64, restricting further rotation of connector 10.

Another function of grommet 18 is to provide a seal between the battery tray 12 and interior of defibrillator 14. This feature can be particularly important when the defibrillator 14 is designed for use in the field, where it may be exposed to moisture or particulate. Although the grommet 18 and wall 22 of tray 12 are designed to cooperatively restrict rotation of the connector 10 upon insertion into opening 20, the grommet 18 is also designed to ensure that opening 20 remains sealed in the event the connector 10 does rotate.

In that regard, the central section 30 of grommet 18 has a circular cross section whose diameter closely approximates the diameter of opening 20. By employing circular cross sections for the central section 30 and opening 20, the grommet 18 will seal opening 20, regardless of the relative rotational position of the two parts.

As discussed in greater detail below, the external section 28 of grommet 18 also provides a seal between the battery pack 16 and battery tray 12. More particularly, when battery pack 16 is inserted into tray 12, the battery pack 16 abuts the upper surface 34 of grommet 18, and slightly compresses the upper section 28 of grommet 18. As a result, the upper surface 34 provides a seal around the external post 26, protecting the connection between connector 10 and battery pack 16 from any contaminants present in the environment of tray 12. The compression of the grommet's upper section 28 further enhances the seal provided around opening 20.

Figure 4:
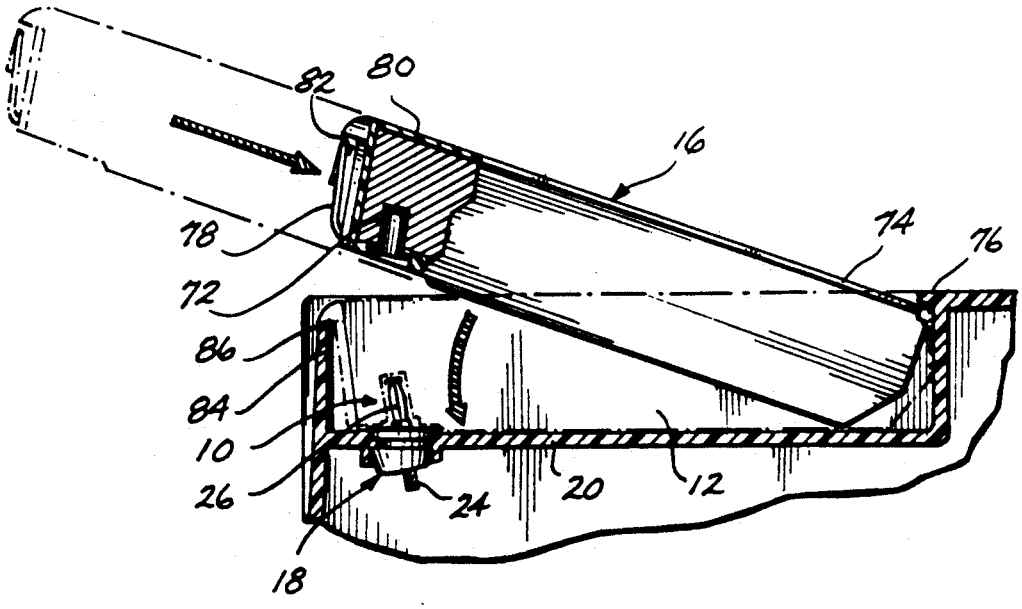
FIG. 4 is a partial sectional view of the defibrillator, connection post, and battery pack of FIG. 1, illustrating the battery pack in a position prior to engaging the connection post.

Addressing now the cooperative interaction of the connector 10 and a mating connector 72 provided in battery pack 16 in greater detail, reference is had to FIGS. 3 and 4. The battery pack 16 is inserted into tray 12 by placing a first end 74 of battery pack 16 in the tray 12 adjacent a lip 76 provided at the end of battery tray 12 opposite connectors 10. A flexible clip 78 extends from the other end 80 of battery pack 16. The clip 78 includes a catch 82 that projects toward the second end 80 of battery pack 16. Because clip 78 is flexible, the catch 82 can be pressed toward battery pack 16.

A U-shaped spring bracket 84 is provided on the battery tray 12 at the end adjacent connectors 10 and opposite lip 76. The bracket 84 includes a pair of arms 86 that are directed toward the tray 12 and battery pack 16. Bracket 84 and clip 78 cooperatively secure the battery pack 16 in tray 12 in the following manner.

As the battery pack 16 is inserted into tray 12 and rotated into position, the arms 86 of bracket 84 force the battery spring clip 78 toward battery pack 16. When the catch 82 on flexible clip 78 clears the arms 86 of bracket 84, the flexible clip 78 flexes away from battery pack 16. At that point, the arms 86 on bracket 84 interfere with catch 82 on clip 78, holding the battery pack in place.

At the same time, the hollow cylindrical connectors 72 provided on battery pack 16 cooperatively receive the external posts 26 of connectors 10. The cylindrical connectors 72 radially compress the spring sections of post 26, providing a good electrical connection therebetween. In this manner, current from battery pack 16 is provided to defibrillator 14 along a path that includes connector 72, external post 26, and internal post 24.

As will be appreciated from FIG. 3, the external section 28 of grommet 18 projects above the external flange 60 around opening 20 a distance d, when the connector 10 is inserted into opening 20. Because the head 56 of external post 26 is embedded below the upper surface 34 of grommet 18, the external post 26 extends partially into grommet 18 when it is fully threaded into the internal post 24. Thus, as noted previously, when the battery pack 16 is inserted into tray 12, the external section 28 of the grommet 18 is compressed. In this condition, the grommet 18 stores energy that can be used to assist in removal of the battery pack 16 in the following manner. The compressed external section 28 of grommet 18 forces the flexible clip 78 upward against the bracket 84. When the battery clip 78 is pushed toward battery pack 16 by an individual using the defibrillator 14, the compressed section 28 of grommet 18 returns to its normal state, forcing the lip 82 of the flexible clip 78 above the bracket arms 86. As a result, removal of the battery pack 16 is made easier.

Also with reference to FIGS. 3 and 4, it should be noted that the internal and external posts 24 and 26 of each connector 10 are aligned along an axis that forms an angle of approximately 10 degrees with respect to an axis normal to the bottom 22 of tray 12. The mating, hollow, cylindrical connectors 72 provided in battery pack 16 are similarly aligned to cooperatively receive the banana portions 58 of connectors 10 upon insertion of battery pack 16 in tray 12. As discussed in the Background section above, the angular alignment of connectors 10 and 72 is employed to reduce any stress applied to connector 10 by battery pack 16 during insertion or use. By resiliently supporting posts 24 and 26, grommet 18 further absorbs any forces applied to post 26 by battery pack 16.

Although the connectors 10 are shown used with a defibrillator 14 in FIG. 1, connectors 10 can also be advantageously employed in other medical instruments. For example, the connectors 10 can be used with cardiac pacers, cardiac monitors, or other instruments combining the functions of defibrillation, pacing, and/or monitoring. In addition, the connectors 10 can be used to mechanically and/or electrically connect batteries to such instruments, as well as to connect various subsections of the instrument to each other, or to connect the instrument to inputs or outputs.

Those skilled in the art will recognize that the embodiments of the invention disclosed herein are exemplary in nature and that various changes can be made therein without departing from the scope and spirit of the invention. In this regard, and as was previously mentioned, the grommet could employ any of a variety of different configurations to limit rotation and to provide the desired seals around the battery connector 72 and interior of defibrillator 14. Further, it will be recognized that a variety of different posts, including single- and two-post arrangements as well as different post terminations, could be employed. Further, it will be recognized that connectors of this type could be employed in other medical instruments. Because of the above and numerous other variations and modifications that will occur to those skilled in the art, the following claims should not be limited to the embodiments illustrated and discussed herein.

The embodiments of the invention in which an exclusive property or privilege is claimed are defined as follows:

1. An apparatus for providing an electrical connection between a defibrillator and a battery pack, comprising:

connection means for providing the connection between the defibrillator and the battery pack; and support means for flexibly supporting said connection means with respect to the defibrillator.

2. The apparatus of claim 1, wherein said connection means and support means are removably attachable to the defibrillator.

3. The apparatus of claim 1, wherein said connection means comprises a first conductive post secured to said support means.

4. The apparatus of claim 3, wherein said connection means further comprises a second conductive post securable to said first conductive post and in axial alignment therewith.

5. The apparatus of claim 3, wherein said support means comprises a grommet.

6. An apparatus for engagement with a connector and positionable in an opening provided in a substantially rigid portion of a housing of a medical instrument, said apparatus comprising:

connection means for engaging the connector; and support means for engaging the opening in the rigid portion of the instrument housing and for flexibly and resiliently supporting said connection means with respect to the rigid portion of the instrument housing, said connection means comprising a first conductive post secured to said support means and a second conductive post securable to said first conductive post, wherein said first conductive post has first and second ends and comprises:

support-engaging means, adjacent said first end, for engaging said support means;

a first threaded section, adjacent said first end, for cooperatively engaging said second conductive post; and a second threaded section adjacent said second end.

7. The apparatus of claim 6, wherein said second conductive post comprises a banana post.

8. An apparatus for engagement with a connector and positionable in an opening provided in a substantially rigid portion of a housing of a medical instrument, said apparatus comprising:

connection means for engaging the connector; and support means for engaging the opening in the rigid portion of the instrument housing and for flexibly and resiliently supporting said connection means with respect to the rigid portion of the instrument housing, said connection means comprising a first conductive post secured to said support means and said support means comprising a grommet, wherein said grommet engages the housing of the instrument along a perimeter that is at least partially noncircular to restrict rotation of the grommet relative to the opening in the housing.

9. The apparatus of claim 8, wherein said perimeter is at least partially teardrop-shaped.

10. An apparatus for engagement with a connector and positionable in an opening provided in a substantially rigid portion of a housing of a medical instrument, said apparatus comprising:

connection means for engaging the connector; and support means for engaging the opening in the rigid portion of the instrument housing and for flexibly and resiliently supporting said connection means with respect to the rigid portion of the instrument housing, wherein said support means comprises a grommet including a connection surface and said connection means comprises a first conductive post secured to said grommet in nonorthogonal alignment with respect to said connection surface.

11. The apparatus of claim 10, wherein said first conductive post has first and second ends, said first end being slightly recessed with respect to said connection surface.

12. The apparatus of claim 10, wherein said connection means further comprises a second conductive post securable to said first post and projecting from said connection surface.

13. A method of coupling a battery having a pair of battery connectors to a medical instrument comprising the steps of:

flexibly supporting a first electrical connector with respect to a housing of the instrument;

flexibly supporting a second electrical connector with respect to the housing of the instrument; and engaging the pair of battery connectors with said first and second electrical connectors.

14. The method of claim 13, wherein the step of engaging the pair of battery connectors with the first and second electrical connectors further comprises the steps of:

inserting one end of the battery into a tray including the first and second electrical connectors and provided on the medical instrument; and rotating the battery about its first end.

15. An apparatus for engagement with a connector and positionable in an opening provided in a substantially rigid portion of a housing of a medical instrument, said apparatus comprising:

connection means for engaging the connector; and support means for engaging the opening in the rigid portion of the instrument housing and for flexibly and resiliently supporting said connection means with respect to the rigid portion of the instrument housing, said support means further comprising means for biasing the connector away from said connection means.

16. An apparatus for engagement with a connector and positionable in an opening provided in a substantially rigid portion of a housing of a medical instrument, said apparatus comprising:

connection means for engaging the connector; and support means for engaging the opening in the rigid portion of the instrument housing and for flexibly and resiliently supporting said connection means with respect to the rigid portion of the instrument housing, said support means further comprising means for resisting rotation of said apparatus relative to the housing and for maintaining a seal with respect to the housing in the event rotation occurs.

* * * * *